US007439431B2

(12) United States Patent
Jakonczuk

(10) Patent No.: US 7,439,431 B2
(45) Date of Patent: Oct. 21, 2008

(54) BANJO TENSIONER

(76) Inventor: Joseph Jakonczuk, 1980 Hwy. 31, Beebe, AR (US) 72012

( * ) Notice: Subject to any disclaimer, the term of this patent is extended or adjusted under 35 U.S.C. 154(b) by 0 days.

(21) Appl. No.: 11/405,189

(22) Filed: Apr. 17, 2006

(65) Prior Publication Data

US 2007/0240555 A1 Oct. 18, 2007

(51) Int. Cl.
*G10D 13/02* (2006.01)

(52) U.S. Cl. ..... 84/413

(58) Field of Classification Search ..... 84/421, 84/411 R, 413

See application file for complete search history.

(56) References Cited

U.S. PATENT DOCUMENTS 1,596,703 A 8/1926 Wiltsie
1,602,409 A 10/1926 Grover
3,376,777 A * 4/1968 Becker-Ehmck ..... 84/419
4,060,018 A 11/1977 Gilbrech
4,206,681 A 6/1980 Kluczynski et al.
4,226,159 A 10/1980 Lowe
4,483,234 A 11/1984 Snavely
4,606,105 A * 8/1986 Snavely ..... 29/896.22
4,612,840 A 9/1986 Gretsch et al.
4,630,521 A * 12/1986 Alletto ..... 84/413
4,928,565 A 5/1990 Hseih

* cited by examiner

*Primary Examiner*—Kimberly R Lockett
(74) *Attorney, Agent, or Firm*—Mark Murphey Henry; Nathan Price Chaney

(57) ABSTRACT

A banjo tensioner is provided in which wave springs inserted between the flange and the nuts operate to maintain a constant tension on the banjo hooks. The invention also contemplates using a wave spring as placed between the washer that applies pressure to the rim and the top coordinator rod nut to maintain the pressure on the inside of the rim. The tensioner may also be used on a drum.

6 Claims, 3 Drawing Sheets

BANJO TENSIONER

CROSS REFERENCES

None.

GOVERNMENTAL RIGHTS

None.

BACKGROUND OF THE INVENTION

A typical banjo has a thin flexible membrane, or head, stretched over a rim and held in place by a tension hoop. The tension hoop is secured to the rim using hooks, and the hooks pass through a flange attached to the rim and are held in place with a plurality of nuts. Attached to the rim using one or two coordinator rods is a long thin structure known as a neck. The coordinator rods pass through apertures in the rim and are held in place with coordinator rod nuts. A tailpiece attached to the tension hoop secures the first end of each of a set of four, five, or six strings. The end of the neck opposite the rim has a plurality of tuning pegs to secure the second end of each of the strings. The tuning pegs also serve to tension the strings to the appropriate tone. The strings transmit sound waves to the head through a bridge. Other components include a resonator and tone ring, which affect the tone of the sound emanated from the banjo.

The component of a banjo that gives the instrument its unique sound is the head. Banjo heads are susceptible to fluctuations in temperature and humidity due to the thinness and large surface area of a typical head. Even a small amount of swelling or shrinkage of the head will cause the tonal quality of the banjo to vary widely. Traditionally, this problem was rectified manually, with the banjo player making frequent adjustments to the nuts, top coordinator rod nut, and tuning pegs. By varying the tightness of the nuts connected to the hooks that secure the tension hoop, the tension of the head can be corrected to maintain the desired tonal quality. It is an object of the present invention to provide an apparatus for maintaining the tension of a banjo head without the need to frequently adjust the nuts.

To a lesser degree, fluctuations in vibration, temperature, and humidity affect the pressure acting upon the top coordinator rod nut, which in turn affects the pressure on the inside of the rim. When this happens, the desired pressure on the rim is lost, and the banjo player must manually readjust the top coordinator rod nut so the rim is not distorted. Then, the banjo player must adjust the tuning pegs to return each string to its desired tone. It is an object of the present invention to provide an apparatus for maintaining the pressure on the top coordinator rod nut without the need for frequent adjustments.

The banjo generates tone using vibrations of strings that are transmitted through the bridge to the head. A side effect of the constant vibration generated by playing a banjo is that the tension hoop and top coordinator rod nut become loose, which affects the tension acting on the head and pressure securing the top coordinator rod nut. It is an object of the present invention to provide an apparatus that maintains the tightness of the tension hoop and pressure on the top coordinator rod nut despite the vibrations caused by playing the banjo.

The inventions of the prior art propose to lessen the tension maintenance problem by providing new ways of making the various structures of the banjo. For instance, U.S. Pat. No. 1,596,703 provides a new resonator attaching device; U.S. Pat. No. 4,060,018 provides an improved drumhead; U.S. Pat. No. 4,483,234 provides a method of fabricating the rim and tone ring; and U.S. Pat. No. 4,206,681 provides a new hook assembly that utilizes threaded bushings to mount the tension hoop. However, none of the devices of the prior art resolve both of the problems discussed above. First, none provide an apparatus that automatically maintains a desired tension on a banjo head throughout temperature and humidity fluctuations. Second, none of the devices of the prior art are capable of being retrofitted to an existing banjo, as all require new construction. It is an object of the present invention to provide an inexpensive, easily retrofitted apparatus for maintaining a desired tension on a banjo head.

The apparatus in accordance with the present invention provides a banjo tensioner that maintains a desired tension on a banjo's head and pressure on the top coordinator rod nut without the need for frequent adjustment. The invention may be retrofitted to banjos already in production and use.

BRIEF SUMMARY OF THE INVENTION

A banjo tensioner is provided in which a wave spring is placed between either the flange and nuts and/or the rim and the top coordinator rod nut. The wave spring is a type of metal washer that utilizes the wave spring's travel to maintain a particular force upon the objects between which the wave spring is sandwiched.

Typically, when a banjo head is subjected to variations in temperature and humidity, the head shrinks or expands, which causes a change in the tension of the head and the sound quality produced by the banjo head changes. The wave spring of the present invention acts to absorb these fluctuations. That is, as the head attempts to shrink or expand, the wave spring travels to counteract such movement such that a constant tension on the banjo head is maintained.

A typical banjo has twenty-four (24) hooks spaced equidistant from one another around a tension hoop. It is desirable to have every tension hoop nut torqued to the same tightness, especially because variations in the tightness among the several nuts causes a degraded tone quality. The wave springs of the present invention help to normalize and equalize the tension applied to each of the several tension hoop nuts to ensure even tension to the various hooks on the head.

The present invention has the additional benefit of lowering the frequency of adjustments it takes to break in a new banjo head. Typically, a new head will stretch significantly. By keeping a constant tension on the hooks, the stretching involved in the breaking-in process is accelerated and the number of adjustments a banjo player must make to counteract the stretching of the new head is thereby reduced.

These and other advantages will become apparent from the following detailed description which, when viewed in light of the accompanying drawings, disclose the embodiments of the present invention.

DETAILED DESCRIPTION OF THE INVENTION

Figure 1:
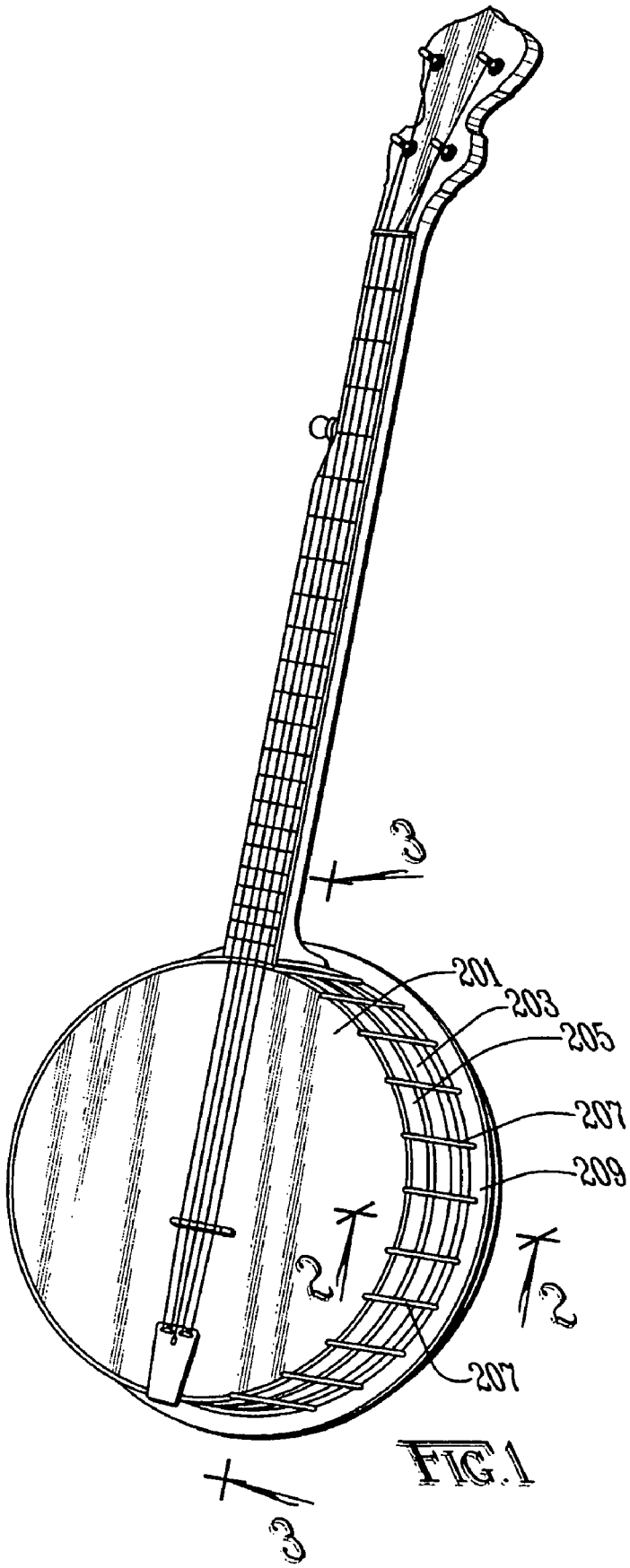
FIG. 1 is a perspective view of a typical banjo.

Experimental testing has demonstrated that a tension range between 48 and 55 pounds is desirable for the nuts securing the hooks of most banjos. The inventor first determined the torque required on the nuts to maintain the desirable tension range, and then tested various sizes and properties of wave springs to determine which size would utilize approximately half of the wave spring's total available travel at the desired torque reading. For the first preferred embodiment of the present invention the inventor selected a wave spring with enough strength and travel to maintain a tension range on the nuts between 45 and 60 pounds. A wave spring capable of maintaining the proper tension has a travel of approximately 0.020 inches, which yields a total travel potential for the head of 0.040 inches. For most banjo applications, this configuration gives the banjo player optimum consistency in the tension of the banjo head.

For the top coordinator rod nut, testing has shown that a pressure range between 30 and 45 pounds is optimum for most banjos. Therefore, for the second preferred embodiment the inventor selected a wave spring with enough strength and travel to maintain a pressure range as between the top coordinator rod nut and the inside of the rim between 30 and 45 pounds. A wave spring capable of maintaining the proper pressure has a travel of approximately 0.060 inches. For most banjo applications, this configuration gives the banjo player optimum consistency in the pressure on the top coordinator rod nut.

The inventor contemplates that the present invention may also be used on other instruments that utilize heads to create sound, particularly percussion instruments. Drums, in particular, utilize a drumhead stretched over a rim and secured by a tension hoop. As the typical drumhead is larger than a banjo head, the shrinkage and expansion that occurs as a result of fluctuations in temperature and humidity, as well as the vibrational effect of loosening the nuts, are also more pronounced for a drum. Due to the larger amount of travel typical of a drumhead, a wave spring having more travel is necessary. Further, drums come in many various sizes due to the demand for a large range of tones for drums, and the tension range for such an apparatus is at least zero to one hundred (0-100) pounds. Therefore, the wave springs necessary to maintain a constant tension on any given drumhead may be between 0.005 and 0.20 inches.

Figure 2:
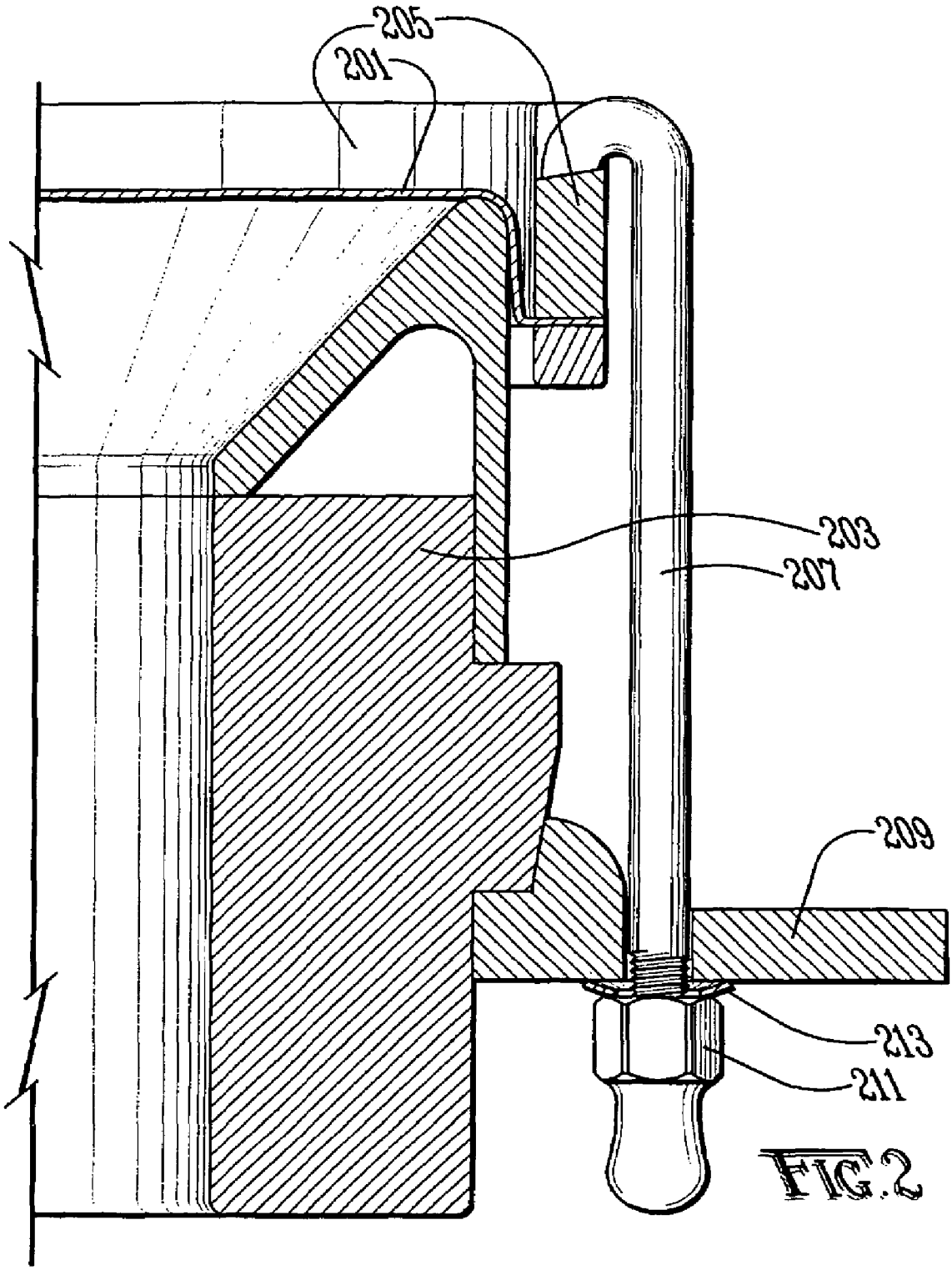
FIG. 2 is a cross-sectional view of the first preferred embodiment of the present invention taken along line 2-2 of FIG. 1.

Referring now to FIG. 2, a head 201 is secured to a rim 203 using a tension hoop 205. A constant force is applied to tension hoop 205 by hook 207, which is threaded through flange 209 and secured by tension hoop nut 211. Wave spring 213 is inserted between flange 209 and tension hoop nut 211 to absorb fluctuations in tension caused by the shrinkage or expansion of head 201.

Figure 3:
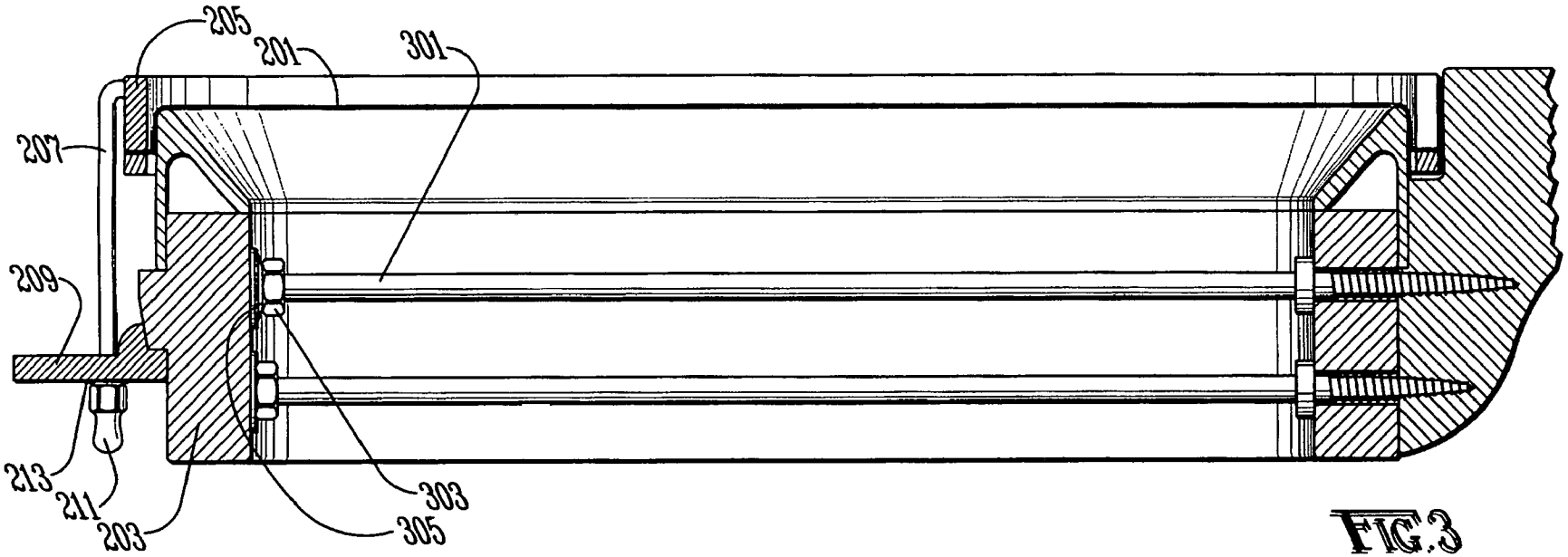
FIG. 3 is a cross-sectional view of the second preferred embodiment of the present invention taken along line 3-3 of FIG. 1.

Referring now to FIG. 3, a top coordinator rod 301 is secured to a rim 203 using top coordinator rod nut 303 and washer 305. The pressure on top coordinator rod. Nut 303 dictates the shape of rim 203 and thus the tension of head 201. Wave spring 307 is inserted between rim 203 and washer 305 to absorb fluctuations in pressure on top coordinator rod nut 303 caused by vibration or temperature or humidity variations.

In accordance with the present invention, a banjo tensioner absorbs shrinkage or expansion in a head by maintaining a constant tension on the hooks. The banjo tensioner of the present invention also serves to maintain a constant pressure on the top coordinator rod nut as well. However, it should be clear that the present invention is not to be construed as limited to the forms shown, which are to be considered illustrative rather than restrictive.

I claim:

1. A tensioner for use with a banjo head as stretched over and secured to a rim using a tension hoop, a plurality of hooks used to apply a tension to the tension hoop, a flange through which the hooks are inserted, and a plurality of nuts used to secure the hooks to the tension hoop such that the hooks apply tension to the tension hoop, consisting essentially of a plurality of wave springs positioned between the nuts and the flange through which the hooks are inserted, wherein the head remains at a constant tension regardless of fluctuations in temperature or humidity.

2. The tensioner of claim 1 wherein the wave spring has a travel of between 0.015 and 0.025 inches.

3. The tensioner of claim 1 wherein the wave springs maintain a tension on the hooks of between 45 and 60 pounds.

4. A tensioner for use in a banjo that has a rim and a neck connected together using a coordinator rod, and a coordinator rod nut applies pressure to the inside of the rim, consisting essentially of a wave spring through which the coordinator rod is inserted, the wave spring being positioned between the coordinator rod nut and the washer which applies pressure to the rim, wherein the head remains at a constant tension regardless of fluctuations in temperature humidity.

5. The tensioner of claim 4 wherein the wave spring has a travel of between 0.050 and 0.070 inches.

6. The tensioner of claim 4 wherein the wave springs maintain a tightness on the top coordinator rod nut of between 30 and 45 pounds.

* * * * *